US011823601B2

(12) United States Patent
Peng

(10) Patent No.: US 11,823,601 B2
(45) Date of Patent: Nov. 21, 2023

(54) ELECTRONIC DEVICE WITH DISPLAY PIXELS SHARING DRIVING CIRCUITS AND DISPLAY METHOD THEREOF

(71) Applicant: Lenovo (Beijing) Limited, Beijing (CN)

(72) Inventor: Shaopeng Peng, Beijing (CN)

(73) Assignee: LENOVO (BEIJING) LIMITED, Beijing (CN)

( * ) Notice: Subject to any disclaimer, the term of this patent is extended or adjusted under 35 U.S.C. 154(b) by 0 days.

(21) Appl. No.: 17/688,234

(22) Filed: Mar. 7, 2022

(65) Prior Publication Data

US 2023/0077303 A1 Mar. 9, 2023

(30) Foreign Application Priority Data

Sep. 7, 2021 (CN) ..... 202111043727.4

(51) Int. Cl.
*G09G 3/3233* (2016.01)
*G09G 3/20* (2006.01)

(52) U.S. Cl.
CPC ..... *G09G 3/20* (2013.01); *G09G 2300/0439* (2013.01); *G09G 2310/08* (2013.01); *G09G 2320/0252* (2013.01)

(58) Field of Classification Search
None
See application file for complete search history.

(56) References Cited

U.S. PATENT DOCUMENTS

| | | | | |
|---|---|---|---|---|
| 2013/0069854 | A1 | 3/2013 | Park et al. | |
| 2018/0293942 | A1* | 10/2018 | Gu | G09G 3/2022 |
| 2021/0074778 | A1 | 3/2021 | Li et al. | |
| 2021/0090501 | A1* | 3/2021 | Wu | G09G 3/3258 |
| 2021/0158746 | A1* | 5/2021 | Li | G09G 3/3225 |
| 2022/0102421 | A1* | 3/2022 | Yang | H10K 59/353 |

FOREIGN PATENT DOCUMENTS

| | | | |
|---|---|---|---|
| CN | 106782301 | A | 5/2017 |
| CN | 112825233 | A | 5/2021 |

* cited by examiner

*Primary Examiner* — Roberto W Flores
*Assistant Examiner* — Donna V Bocar
(74) *Attorney, Agent, or Firm* — ANOVA LAW GROUP, PLLC

(57) ABSTRACT

An electronic device includes a camera and a display screen located above the camera. A display output area of the display screen includes a first area corresponding to image collection areas of the camera and a second area not overlapping with the first area. The display screen includes a sharing pixel corresponding to the first area and a shared pixel, the sharing pixel including at least three sub-pixels. Each sub-pixel of the at least three sub-pixels of the sharing pixel is commonly controlled based on a first control signal of a driving sub-circuit in a driving circuit of the shared pixel, and individually controlled based on a second control signal.

10 Claims, 5 Drawing Sheets

ELECTRONIC DEVICE WITH DISPLAY PIXELS SHARING DRIVING CIRCUITS AND DISPLAY METHOD THEREOF

CROSS-REFERENCE TO RELATED APPLICATION

This application claims priority to Chinese Patent Application No. 202111043727.4, filed on Sep. 7, 2021, the entire content of which is incorporated herein by reference.

TECHNICAL FIELD

The present disclosure relates to the technical field of electronics technologies and, more particularly, to an electronic device and display method.

BACKGROUND

As the electronics technologies advance, more and more electronic devices integrate an image acquisition function. Currently, electronic devices with an image capturing function often adopt an under-screen camera solution, that is, using a camera disposed under a display screen to acquire images. As under-screen cameras are widely adopted in electronic devices, increasing an amount of light entering a camera to improve an image capture quality of the camera has become a research hotspot for researchers in the field.

SUMMARY

One aspect of the present disclosure provides an electronic device. The electronic device includes a camera and a display screen located above the camera. A display output area of the display screen includes a first area corresponding to image collection areas of the camera and a second area not overlapping with the first area. The display screen includes a sharing pixel corresponding to the first area and a shared pixel, the sharing pixel including at least three sub-pixels. Each sub-pixel of the at least three sub-pixels of the sharing pixel is commonly controlled based on a first control signal of a driving sub-circuit in a driving circuit of the shared pixel, and individually controlled based on a second control signal.

Another aspect of the present disclosure provides a display method for an electronic device. The display method includes: at a first moment, controlling a sub-pixel of a shared pixel of the electronic device to display using a driving sub-circuit in a driving circuit of the shared pixel; and at a second moment different from the first moment, controlling a sub-pixel of a sharing pixel of the electronic device to display using the driving sub-circuit in the driving circuit of the shared pixel. The electronic device includes a camera and a display screen. A display output area of the display screen includes a first area corresponding to an image collection area of the camera and a second area not overlapping with the first area. The sharing pixel is located in the first area.

BRIEF DESCRIPTION OF THE DRAWINGS

To more clearly illustrate the technical solution of the present disclosure, the accompanying drawings used in the description of the disclosed embodiments are briefly described below. The drawings described below are merely some embodiments of the present disclosure. Other drawings may be derived from such drawings by a person with ordinary skill in the art without creative efforts and may be encompassed in the present disclosure.

DETAILED DESCRIPTION OF THE EMBODIMENTS

Embodiments of the present disclosure are described in detail below with reference to the accompanying drawings. It will be appreciated that the described embodiments are some rather than all of the embodiments of the present disclosure. Other embodiments obtained by those having ordinary skills in the art on the basis of the described embodiments without inventive efforts should fall within the scope of the present disclosure.

Many specific details are set forth in the following description to facilitate a complete understanding of the present disclosure. However, the present disclosure can also be implemented in other ways different from those described herein, and those skilled in the art can do so without departing from the scope of the present disclosure. Therefore, the present disclosure is not limited by the specific embodiments described below.

As described in the background section, how to increase the amount of light entering the camera to improve the image acquisition quality of the camera has become a research hotspot for researchers in the field.

Figure 1:
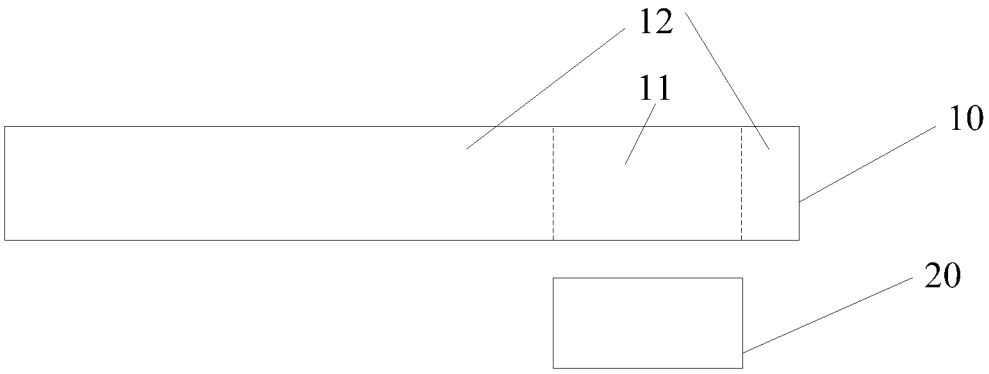
FIG. 1 is a schematic structural diagram of an exemplary electronic device according to some embodiments of the present disclosure.
Figure 2:
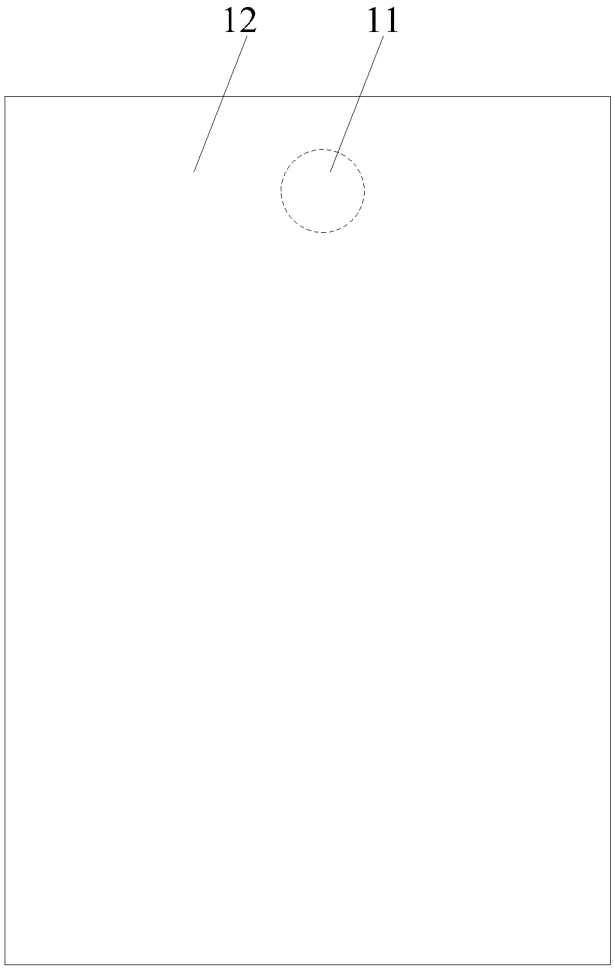
FIG. 2 is a schematic top view of a display output area of an exemplary electronic device according to some embodiments of the present disclosure.

In view of this, the present disclosure provides an electronic device. As shown in FIG. 1 and FIG. 2, the electronic device includes a camera 20 and a display screen 10. The display screen 10 is located above the camera 20. A display output area of the display screen 10 includes a first area 11 corresponding to an image collection area of the camera 20 and a second area 12. The first area 11 and the second area 12 do not overlap.

Figure 3:
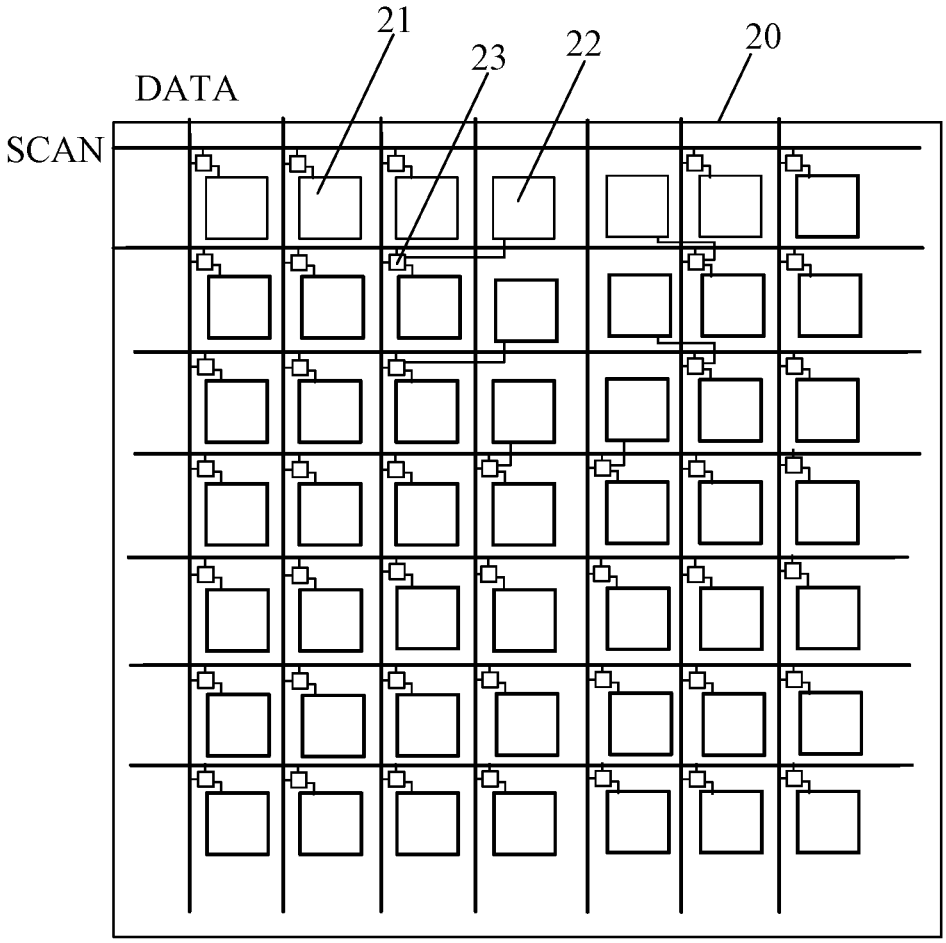
FIG. 3 is a schematic top view of an internal structure of an exemplary electronic device according to some embodiments of the present disclosure.

In some embodiments, as shown in FIG. 3, the display screen 20 includes a plurality of display pixels corresponding to the first area. Each display pixel includes at least three sub-pixels 21. The plurality of display pixels includes sharing pixels. Each sub-pixel 22 of the at least three sub-pixels of each sharing pixel is commonly controlled based on a first control signal of a corresponding driving sub-circuit 23 in a driving circuit of a shared pixel to reduce a footprint of driving sub-circuits in an area where sub-pixels 22 of each sharing pixel are located. As such, under the circumstance that a total number of sub-pixels in the first area remains unchanged, a light-transmission area in the first area increases, an amount of light transmitting through the first are increases, and the amount of light entering the camera located under the first area of the display screen increases, thereby improving the image acquisition quality of the camera.

In some embodiments, each sub-pixel of the at least three sub-pixels of each sharing pixel is individually controlled based on a second control signal. As such, each sub-pixel of the at least three sub-pixels of each sharing pixel is individually controlled based on the second control signal in addition to being commonly controlled based on the first control signal of the corresponding driving sub-circuit in the driving circuit of each shared pixel, such that the sub-pixels of each sharing pixel that are commonly controlled by a same driving sub-circuit and sub-pixels of each shared pixel can be displayed independently. Thus, while the light transmittance in the first area of the display screen increases and the amount of light entering the camera increases, display resolution in the first area of the display screen does not decrease, thereby ensuring display quality of the display screen.

Figure 4:
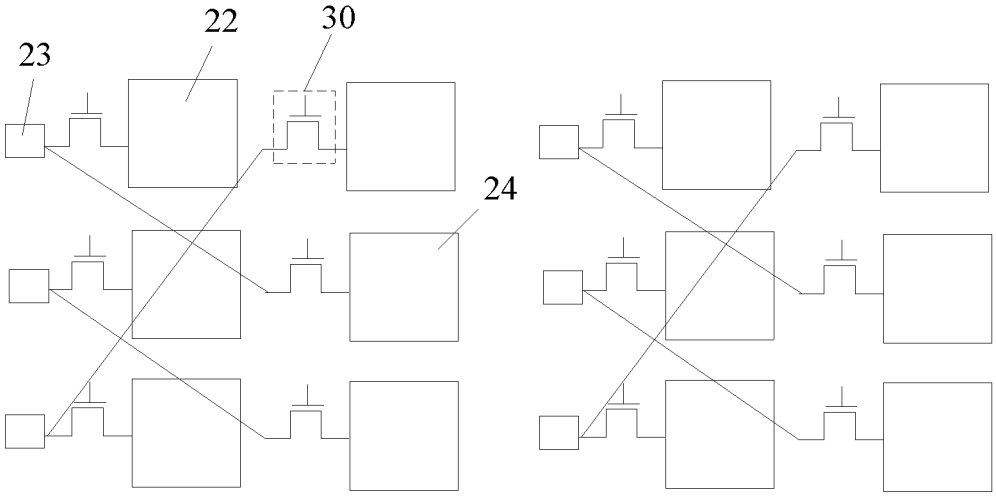
FIG. 4 is a schematic diagram showing structural connection between a sub-pixel of a sharing pixel and a sub-pixel of a shared pixel in an exemplary electronic device according to some embodiments of the present disclosure.
Figure 5:
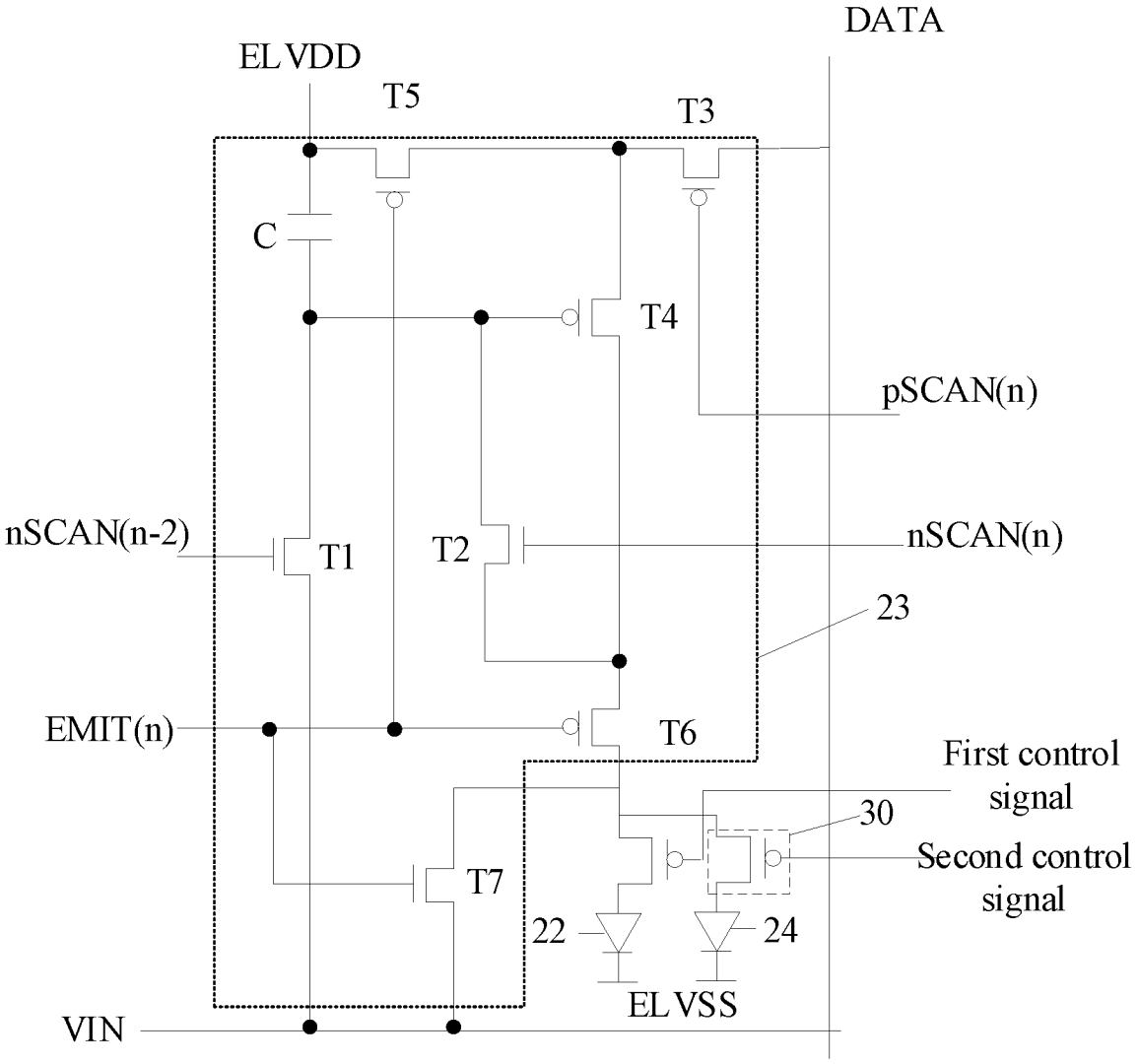
FIG. 5 is a schematic diagram showing electrical connection between a sub-pixel of a sharing pixel and a sub-pixel of a shared pixel in an exemplary electronic device according to some embodiments of the present disclosure.

In one embodiment, as shown in FIG. 4 and FIG. 5, the electronic device further includes a plurality of control switches 30. The sub-pixels 22 of the sharing pixel controlled by the same driving sub-circuit 23 and sub-pixels 24 of the shared pixel are electrically connected to the driving sub-circuit 23 through the plurality of control switches 30. The second control signal is inputted to a control terminal of the plurality of control switches 30. An operation state of the plurality of control switches 30 is controlled based on the second control signal to turn on and off a connection path between the driving sub-circuit and each corresponding sub-pixel.

In some embodiments, the driving sub-circuit is a pixel driving circuit. The pixel driving circuit includes a plurality of transistors and a plurality of signal lines. The plurality of transistors includes a gate initialization transistor T1, a compensation transistor T2, a data writing transistor T3, a driving transistor T4, a power supply writing transistor T5, a light-emission control transistor T6, and a positive electrode initialization transistor T7. During a normal operation, the plurality of transistors responds to a gate line SCAN signal to control a light-emission state of each sub-pixel. nNSCAN(n) is a scan signal of an N-type transistor of a pixel in the nth row. pNSCAN(n) is a scan signal of a P-type transistor of a pixel in the nth row. nNSCAN(n−2) is a scan signal of an N-type transistor of a pixel in the (n−2)th row. ELVDD is a power supply signal. DATA is a data signal. EMIT is a light-emission control signal. ELVSS is a ground signal.

In some embodiments, the sub-pixels controlled by the same driving sub-circuit include one sub-pixel of the sharing pixel and one sub-pixel of the shared pixel. The one sub-pixel of the sharing pixel is electrically connected to the driving sub-circuit through a control switch. The one sub-pixel of the shared pixel is electrically connected to the driving sub-circuit through another control switch. Thus, the sub-pixel of the sharing pixel and the sub-pixel of the shared pixel that are electrically connected to the driving sub-circuit can display independently.

Figure 6:
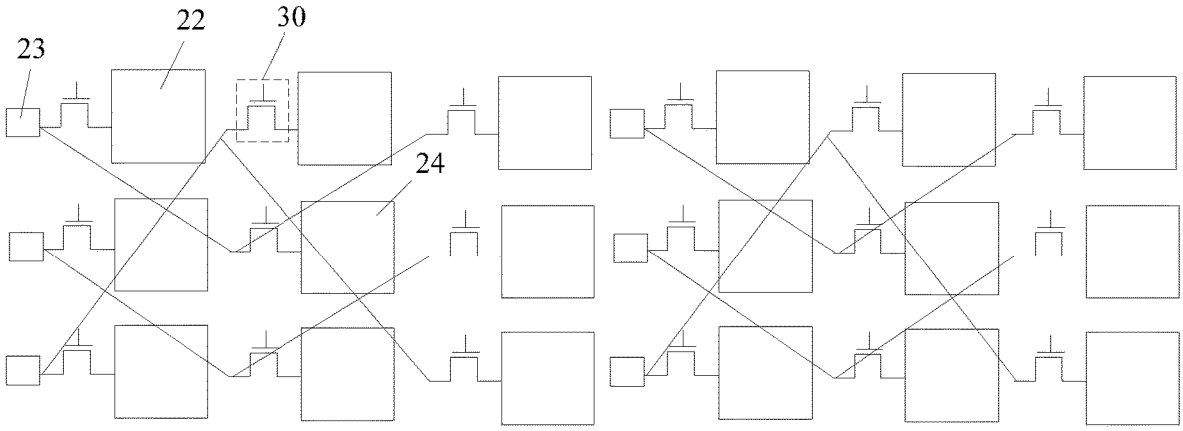
FIG. 6 is a schematic diagram showing structural connection between a sub-pixel of a sharing pixel and a sub-pixel of a shared pixel in another exemplary electronic device according to some embodiments of the present disclosure.

In some embodiments, one driving sub-circuit of the shared pixel driving circuit may be electrically connected to one sub-pixel of the sharing pixel or may be electrically connected to multiple sub-pixels of the shared pixel, as shown in FIG. 6. The present disclosure does not limit the circuit configuration, which can be determined as needed.

In some embodiments, a quantity of the sub-pixels controlled by the driving sub-circuit of one shared pixel driving circuit is the same as a quantity of the second control signals in the electronic device. That is, if the driving sub-circuit of the shared pixel driving circuit controls M sub-pixels, the electronic device needs M second control signals. M sub-pixels includes the sub-pixels of the sharing pixel and the sub-pixels of the shared pixel.

In some embodiments, the plurality of sub-pixels that are electrically connected to the same driving sub-circuit does not operate at the same time. When each of the plurality of sub-pixels operates, the data signal outputted from the driving sub-circuit matches the data signal required by the sub-pixel currently in the operation state. As such, the plurality of sub-pixels electrically connected to the same driving sub-circuit needs different data signals, and the plurality of sub-pixels electrically connected to the same driving sub-circuit can display independently. However, the present disclosure is not limited to this scenario. Other scenarios may be possible as needed.

In some embodiments, when each of the plurality of sub-pixels operates, the matching of the data signal outputted from the driving sub-circuit with the data signal required by the sub-pixel currently in the operation state includes at least one of data signal amplitude matching or data signal synchronization. The data signal amplitude matching refers to that the amplitude of the data signal outputted from the driving sub-circuit is the same as the amplitude of the data signal required by the sub-pixel currently in the operation state. For example, the amplitude of the data signal required by the sub-pixel currently in the operation state is 2 V, and the amplitude of the data signal outputted from the driving sub-circuit is also 2 V or approximately 2 V. The data signal synchronization refers to that the data signal outputted from the driving sub-circuit is synchronized with or approximately synchronized with the data signal required by the sub-pixel currently in the operation state. For example, when the sub-pixel currently in the operation state starts operation, the driving sub-circuit starts outputting the data signal required by the sub-pixel currently in the operation state. When the sub-pixel currently in the operation state stops operation, the driving sub-circuit stops outputting the data signal required by the sub-pixel currently in the operation state.

Figure 7:
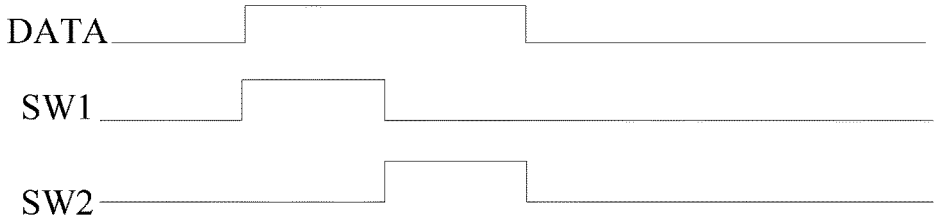
FIG. 7 is a timing diagram of subpixel control signals in an exemplary electronic device according to some embodiments of the present disclosure.

For illustration purpose, the plurality sub-pixels controlled by the same driving sub-circuit including one sub-pixel of the sharing pixel and one sub-pixel of the shared pixel is described below with reference to FIG. 7. FIG. 7 is a timing diagram of subpixel control signals in an exemplary electronic device according to some embodiments of the present disclosure. FIG. 7 shows the timing diagram of the data signal DATA inputted into the driving sub-circuit, the second control signal SW1 inputted into the control terminal of the control switch corresponding to the sub-pixel of the shared pixel electrically connected to the driving sub-circuit, and the second control signal SW2 inputted into the control terminal of the control switch corresponding to the sub-pixel of the sharing pixel electrically connected to the driving sub-circuit, in a case where the plurality sub-pixels controlled by the same driving sub-circuit include one sub-pixel of the sharing pixel and one sub-pixel of the shared pixel. In some embodiments, as shown in FIG. 7, different sub-pixels controlled by the same driving sub-circuit do not operate at the same time.

Figure 8:
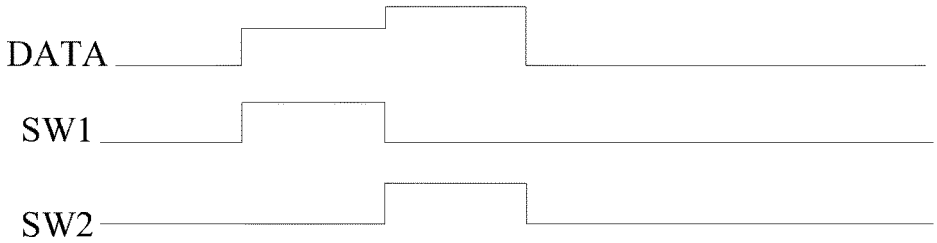
FIG. 8 is a timing diagram of subpixel control signals in another exemplary electronic device according to some embodiments of the present disclosure.

In some embodiments, when different sub-pixels controlled by the same driving subcircuit operate, the data signal outputted from the driving sub-circuit may be the same, as shown in FIG. 7, or may be different, as shown in FIG. 8, which is not limited in this disclosure and can be determined as needed.

In some embodiments, each display pixel includes three sub-pixels, such as a red sub-pixel, a green sub-pixel, and a blue sub-pixel. In some other embodiments, each display pixel includes four sub-pixels, such as the red sub-pixel, the green sub-pixel, the blue sub-pixel, and a white sub-pixel. The present disclosure does not limit sub-pixel arrangement as long as each display pixel includes at least three sub-pixels.

In some embodiments, the shared pixel includes the red sub-pixel, the green sub-pixel, and the blue sub-pixel. The driving circuit of the shared pixel includes three driving sub-circuits for driving the red sub-pixel, the green sub-pixel, and the blue sub-pixel, respectively. In some embodiments, a sub-pixel of the sharing pixel is commonly controlled based on the first control signal of the driving sub-circuit corresponding to the sub-pixel of the shared pixel that has a same color as the sub-pixel of the sharing pixel. That is, a sub-pixel of the sharing pixel and a sub-pixel of the shared pixel that has a same color as the sub-pixel of the sharing pixel are both (commonly) controlled based on the first control signal of the driving sub-circuit corresponding to the sub-pixel of the shared pixel.

In some embodiments, each display pixel at least includes a first sub-pixel, a second sub-pixel, and a third sub-pixel, which have three different colors. In some embodiments, the first sub-pixel of the sharing pixel is commonly controlled based on the first control signal of the driving sub-circuit corresponding to the first sub-pixel of the shared pixel. The second sub-pixel of the sharing pixel is commonly controlled based on the first control signal of the driving sub-circuit corresponding to the second sub-pixel of the shared pixel. The third sub-pixel of the sharing pixel is commonly controlled based on the first control signal of the driving sub-circuit corresponding to the third sub-pixel of the shared pixel.

For illustration purpose, a case where the first sub-pixel is the R (red) sub-pixel, the second sub-pixel is the G (green) sub-pixel, and the third sub-pixel is the B (blue) sub-pixel is described below. In some embodiments, the R sub-pixel of the sharing pixel is commonly controlled based on the first control signal of the driving sub-circuit corresponding to the R sub-pixel of the shared pixel. The G sub-pixel of the sharing pixel is commonly controlled based on the first control signal of the driving sub-circuit corresponding to the G sub-pixel of the shared pixel. The B sub-pixel of the sharing pixel is commonly controlled based on the first control signal of the driving sub-circuit corresponding to the B sub-pixel of the shared pixel.

In some embodiments, the sub-pixel of the sharing pixel can also be commonly controlled based on the first control signal of the driving sub-circuit corresponding to the sub-pixel of the shared pixel that has a different color, which is not limited thereto, and can be determined as needed. In one example, the first sub-pixel of the sharing pixel is commonly controlled based on the first control signal of the driving sub-circuit corresponding to the second sub-pixel of the shared pixel. The second sub-pixel of the sharing pixel is commonly controlled based on the first control signal of the driving sub-circuit corresponding to the third sub-pixel of the shared pixel. The third sub-pixel of the sharing pixel is commonly controlled based on the first control signal of the driving sub-circuit corresponding to the first sub-pixel of the shared pixel. In another example, the first sub-pixel of the sharing pixel is commonly controlled based on the first control signal of the driving sub-circuit corresponding to the third sub-pixel of the shared pixel. The second sub-pixel of the sharing pixel is commonly controlled based on the first control signal of the driving sub-circuit corresponding to the first sub-pixel of the shared pixel. The third sub-pixel of the sharing pixel is commonly controlled based on the first control signal of the driving sub-circuit corresponding to the second sub-pixel of the shared pixel.

In some embodiments, some sub-pixels of the sharing pixel are commonly controlled based on the first control signal of the driving sub-circuits corresponding to some sub-pixels in the driving circuit of the same shared pixel that have the same colors. Some other sub-pixels of the sharing pixel are commonly controlled based on the first control signal of the driving sub-circuits corresponding to some other sub-pixels in the driving circuit of the same shared pixel that have different colors. The present disclosure does not impose any limitation and it can be determined as needed.

In some embodiments, different sub-pixels of the sharing pixel are commonly controlled based on the first control signal of the driving sub-circuits corresponding to different sub-pixels in the driving circuit of the same shared pixel. For example, the first sub-pixel of a first sharing pixel is commonly controlled based on the first control signal of the driving sub-circuit corresponding to the first sub-pixel in the driving circuit of a first shared pixel. The second sub-pixel of the first sharing pixel is commonly controlled based on the first control signal of the driving sub-circuit corresponding to the second sub-pixel in the driving circuit of the first shared pixel. The third sub-pixel of the first sharing pixel is commonly controlled based on the first control signal of the driving sub-circuit corresponding to the third sub-pixel in the driving circuit of the first shared pixel.

In some embodiments, different sub-pixels of the sharing pixel are commonly controlled based on the first control signal of the driving sub-circuits corresponding to driving circuits of different shared pixels. For example, the first sub-pixel of the first sharing pixel is commonly controlled based on the first control signal of the driving sub-circuit corresponding to the first sub-pixel in the driving circuit of the first shared pixel. The second sub-pixel of the first sharing pixel is commonly controlled based on the first control signal of the driving sub-circuit corresponding to the second sub-pixel in the driving circuit of a second shared pixel. The third sub-pixel of the first sharing pixel is commonly controlled based on the first control signal of the driving sub-circuit corresponding to the third sub-pixel in the driving circuit of a third shared pixel.

In some embodiments, there may be other methods of sharing the driving sub-circuits corresponding to the sub-pixels of the shared pixel by the sub-pixels of the sharing pixel. For example, different sub-pixels of some sharing pixels are commonly controlled based on the first control signal of the driving sub-circuits corresponding to different sub-pixels in the driving circuit of the same shared pixel. Different sub-pixels of some sharing pixels are commonly controlled based on the first control signal of the corresponding driving sub-circuits in the driving circuits of different shared pixels. The present disclosure does not impose any limitation and it can be determined as needed.

In some embodiments, the shared pixel is located in the first area. That is, the sharing pixel and the shared pixel both are located in the first area of the display screen. Thus, a distance between the sub-pixel of the sharing pixel and the corresponding driving sub-circuit in the driving circuit of the shared pixel can be reduced, signal transmission loss can be reduced, and response speed of the sub-pixels of the sharing pixel can be improved.

In some embodiments, the display screen further includes a plurality of display pixels in the second area. The shared pixels are located in the second area. That is, the sharing pixels are located in the first area and the shared pixels are located in the second area. Through configuring the shared pixels in the second area, no driving sub-circuits is configured in the first area where the sub-pixels are located. Thus, the light transmittance in the first area of the display screen can be maximized, and the amount of light entering the camera located under the first area of the display screen can be maximized.

In some embodiments, when the shared pixels are located in the second area, the shared pixels are the display pixels closest to the first area among the plurality of display pixels located in the second area, such that the amount of light entering the camera located under the first area of the display screen can be maximized, and the distance between the shared pixel and the corresponding sharing pixel can be reduced. Thus, the distance between the sub-pixel of the sharing pixel and the corresponding driving sub-circuit in the driving circuit of the shared pixel can be shortened, the signal transmission loss can be reduced, and the response speed of the sub-pixels in the sharing pixel can be improved. The present disclosure does not impose any limitation and it can be determined as needed.

In some embodiments, the electronic device includes a plurality of shared pixels. Some shared pixels are located in the first area. Some other shared pixels are located in the second area. The present disclosure does not impose any limitation and it can be determined as needed.

In some embodiments, a difference between a density of the display pixels in the first area and a density of the display pixels in the second area ranges approximately between 0% and 10% inclusive. Thus, the light transmittance in the first area of the display screen is increased, the density of the display pixels in the first area is increased, and the display resolution in the first area of the display screen is increased.

Figure 9:
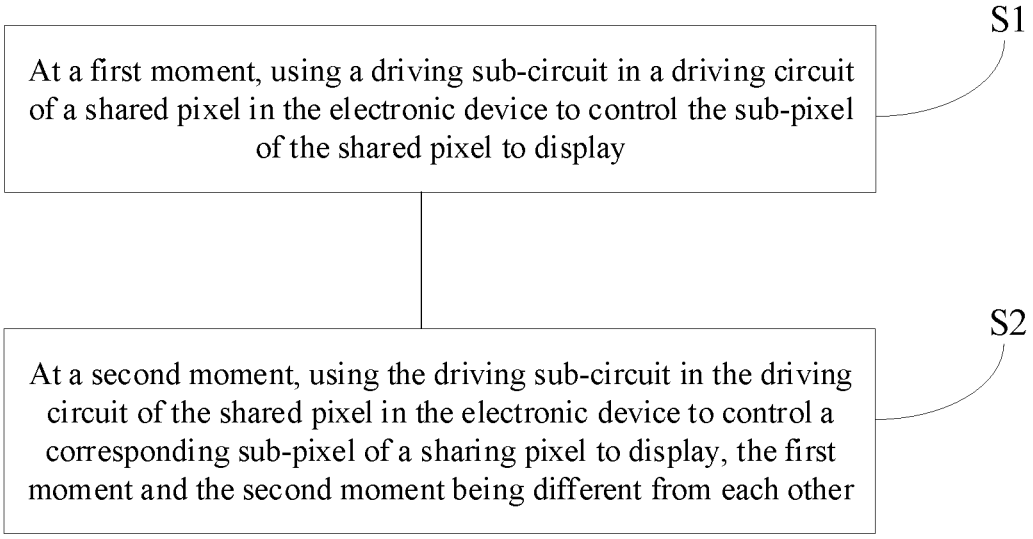
FIG. 9 is a flowchart of an exemplary display method according to some embodiments of the present disclosure.

In addition, the present disclosure further provides a display method. The display method can be applied to the electronic device in any of the previously described embodiments. In some embodiments, the electronic device includes a camera and a display screen. A display output area of the display screen includes a first area corresponding to an image collection area of the camera and a second area. The first area and the second area do not overlap. Sharing pixels are located in the first area. As shown in FIG. 9, the display method includes the following processes.

At S1, at a first moment, a driving sub-circuit in a driving circuit of a shared pixel in the electronic device is used to control the sub-pixel of the shared pixel to display.

At S2, at a second moment, the driving sub-circuit in the driving circuit of the shared pixel in the electronic device is used to control a corresponding sub-pixel of a sharing pixel to display. The first moment and the second moment are different from each other, such that sub-pixel of the sharing pixel and the sub-pixel of the shared pixel can display independently.

In some embodiments, the electronic device further includes a control switch located between the driving sub-circuit in the driving circuit of the shared pixel and each sub-pixel controlled by the driving sub-circuit. In some embodiments, each of control switches that are electrically connected to the same driving sub-circuit is not turned on at the same time to ensure that each sub-pixel electrically connected to the same driving sub-circuit can display independently. Correspondingly, the display method includes the following processes.

At a first moment, a path between the driving sub-circuit in the driving circuit of the shared pixel and the corresponding sub-pixel of the shared pixel is controlled to be turned on, and a path between the driving sub-circuit in the driving circuit of the shared pixel and the corresponding sub-pixel of the sharing pixel is controlled to be turned off. The driving sub-circuit controls the display of the corresponding sub-pixel of the shared pixel.

At a second moment, the path between the driving sub-circuit in the driving circuit of the shared pixel and the corresponding sub-pixel of the shared pixel is controlled to be turned off, and the path between the driving sub-circuit in the driving circuit of the shared pixel and the corresponding sub-pixel of the sharing pixel is controlled to be turned on. The driving sub-circuit controls the display of the corresponding sub-pixel of the sharing pixel.

In some embodiments, a plurality of display pixels is also configured in the second area of the display screen. In some embodiments, as shown in FIG. 3, the plurality of display pixels of the display screen is arranged in a matrix along row and column directions in the display output area of the display screen. The electronic device further includes a plurality of scan lines SCAN extending along the column direction and a plurality of data lines DATA extending along the row direction. Each column of the plurality of scan lines SCAN is electrically connected to a row of driving sub-circuits. Each row of the plurality of data lines DATA is electrically connected to a column of driving sub-circuits. The plurality of scan lines is configured to control a conduction state of connections between the plurality of data lines and output terminals of the driving sub-circuits.

In some embodiments, when the display screen is in operation, the display method further includes: supplying driving signals to each scan line one by one along the column direction to scan the driving sub-circuits row by row to control a path between each row of the driving sub-circuits and the corresponding sub-pixels to turn on sequentially; and when the path between each row of the driving sub-circuits and the corresponding sub-pixels is turned on, providing data signals through the data lines to the sub-pixels that are connected to the output terminals of the currently scanned driving sub-circuits to display on the entire display screen.

In some embodiments, when different sub-pixels controlled by a same driving sub-circuit are in operation, the data signals outputted from the same driving sub-circuit may be the same or may be different. The present disclosure does not impose any limitation and it can be determined as needed.

In the electronic device and the display method according to the embodiments of the present disclosure, each sub-pixel in the at least three sub-pixels of the sharing pixel is commonly controlled based on the first control signal of the corresponding driving sub-circuit in the driving circuit of the shared pixel, such that less driving sub-circuit can be configured in the area where the sub-pixels of the sharing pixel are located. Thus, under the circumstance that the total number of the sub-pixels configured in the first area remains unchanged, the light-transmission area in the first area is increased, the light transmittance in the first area is increased, the amount of light entering the camera located under the first area of the display screen is increased, and the image collection quality of the camera is improved.

In addition, in the electronic device and the display method according to the embodiments of the present disclosure, each sub-pixel in the at least three sub-pixels of the sharing pixel is individually controlled based on the second control signal, such that each sub-pixel in the at least three sub-pixels of the sharing pixel is also individually controlled based on the second control signal in addition to being commonly controlled based on the first control signal of the corresponding driving sub-circuit in the driving circuit of the shared pixel, and the sub-pixels of the sharing pixel and the sub-pixels of the shared pixel that are commonly controlled by the same driving sub-circuit can display independently. Thus, the light transmittance in the first are of the display screen is increased, the amount of light entering the camera is increased, the display resolution in the first area of the display screen is not decreased, and the display quality of the display screen is ensured.

Various embodiments in the specification are described in a progressive manner, and each embodiment focuses on the differences from other embodiments, and for the same and similar parts between the various embodiments, reference can be made to each other. At the same time, the features described in the embodiments in the specification may be replaced or combined with each other, such that those skilled in the art can realize or use the present disclosure. As for the devices disclosed in the embodiments, because of the correspondence to the method disclosed in the embodiments, the description is relatively simple, and reference can be made to the description of the method for relevant parts.

It should also be noted that in the specification, relational terms such as first and second are used only to distinguish one entity or operation from another, and do not necessarily require or imply that there is such actual relationship or order between those entities or operations. Moreover, the terms "comprising," "including" or any other variation thereof are intended to encompass non-exclusive inclusion such that a process, method, article or device comprising a list of elements includes not only those elements, but also includes not explicitly listed or other elements inherent to such a process, method, article or apparatus. Without further limitation, an element qualified by the phrase "comprising a . . . " does not preclude the presence of additional identical elements in a process, method, article or apparatus that includes the element.

Those skilled in the art can further realize that the units and algorithm steps of the examples described in the embodiments disclosed in the specification can be implemented by electronic hardware, computer software, or a combination of both. To clearly illustrate interchangeabilities of hardware and software, the structures and steps of each example have been generally described in the specification in accordance with the functions. Whether these functions are implemented by hardware or software depends on the specific application and design constraints of the technical solution. Those skilled in the art can use different methods for each specific application to implement the described functions, but such implementation should not be considered beyond the scope of this application.

The processes of the method or algorithm described in the embodiments disclosed in the specification can be directly implemented by hardware, a software module executed by a processor, or a combination thereof. The software module can be stored in random access memory (RAM), internal memory, read-only memory (ROM), electrically programmable ROM, electrically erasable programmable ROM, registers, hard disks, removable disks, CD-ROMs, or any other storage media known in the technical field.

The above description of the disclosed embodiments enables those skilled in the art to implement or use this application. Various modifications to these embodiments will be obvious to those skilled in the art, and the general principles defined herein can be implemented in other embodiments without departing from the spirit or scope of the present application. Therefore, this application will not be limited to the embodiments shown in the specification, but should conform to the broadest scope consistent with the principles and novelties disclosed in the specification.

What is claimed is:

1. An electronic device comprising:

a camera; and a display screen located above the camera;

wherein:

a display output area of the display screen includes:

a first area corresponding to image collection areas of the camera; and a second area corresponding to an area other than the image collection areas of the camera and being not overlapping with the first area;

the display screen includes a sharing pixel corresponding to the first area and a shared pixel, the sharing pixel including at least three sub-pixels; each sub-pixel of the at least three sub-pixels of the sharing pixel is:

commonly controlled based on a first control signal of a driving sub-circuit in a driving circuit of the shared pixel, and individually controlled based on a second control signal;

the sharing pixel is located in the first area;

the shared pixel is located in the second area; and the driving circuit of the shared pixel is located in the second area;

wherein sub-pixels of the sharing pixel located in the first area are only controlled by the same driving sub-circuit of the shared pixel which are located in the second area.

2. The electronic device according to claim 1, wherein:

each of the sharing pixel and the shared pixel includes a first sub-pixel, a second sub-pixel, and a third sub-pixel;

the first sub-pixel of the sharing pixel is commonly controlled based on the first control signal of the driving sub-circuit corresponding to the first sub-pixel of the shared pixel;

the second sub-pixel of the sharing pixel is commonly controlled based on the first control signal of the driving sub-circuit corresponding to the second sub-pixel of the shared pixel; and the third sub-pixel of the sharing pixel is commonly controlled based on the first control signal of the driving sub-circuit corresponding to the third sub-pixel of the shared pixel.

3. The electronic device according to claim 1, further comprising:

a plurality of control switches, each of the plurality of control switches:

including a control terminal configured to receive the second control signal, and electrically connecting one sub-pixel of the at least three sub-pixels of the sharing pixel and one sub-pixel of the shared pixel that are commonly controlled by a same driving sub-circuit to the same driving sub-circuit.

4. The electronic device according to claim 3, wherein:

the one sub-pixel of the sharing pixel and the one sub-pixel of the shared pixel connected to the same driving sub-circuit do not operate simultaneously; and during operation of one of the one sub-pixel of the sharing pixel and the one sub-pixel of the shared pixel, a data signal outputted from the driving sub-circuit matches a data signal required for the one of the one sub-pixel of the sharing pixel and the one sub-pixel of the shared pixel.

5. The electronic device according to claim 1, wherein:

the shared pixel is one of a plurality of shared pixels; and different ones of the at least three sub-pixels of the sharing pixel are controlled based on the first control signal of the corresponding driving sub-circuits in the driving circuits of different ones of the plurality of shared pixels.

6. The electronic device according to claim 1, wherein a difference between a display pixel density in the first area and a display pixel density in the second area is in a range between 0% and 10% inclusive.

7. The electronic device according to claim 1, wherein a quantity of second control signals needed by the electronic device equals a sum of:

a quantity of sub-pixels of the sharing pixel; and a quantity of sub-pixels of the shared pixel.

8. A display method for an electronic device comprising:

at a first moment, controlling a sub-pixel of a shared pixel of the electronic device to display using a driving sub-circuit in a driving circuit of the shared pixel; and at a second moment different from the first moment, controlling a sub-pixel of a sharing pixel of the electronic device to display using the driving sub-circuit in the driving circuit of the shared pixel;

wherein:

the electronic device includes a camera and a display screen;

a display output area of the display screen includes:

a first area corresponding to an image collection area of the camera; and a second area corresponding to an area other than the image collection area of the camera and being not overlapping with the first area;

the sharing pixel is located in the first area;

the shared pixel is located in the second area; and the driving circuit of the shared pixel is located in the second area; wherein sub-pixels of the sharing pixel located in the first area are only controlled by the same driving sub-circuit of the shared pixel which are located in the second area.

9. The display method according to claim 8, wherein:

the electronic device further includes a control switch located between:

the driving sub-circuit of the shared pixel, and the sub-pixel of the sharing pixel and the sub-pixel of the shared pixel;

controlling the sub-pixel of the shared pixel to display using the driving sub-circuit of the shared pixel at the first moment includes, at the first moment, controlling the control switch to turn on a path between the driving sub-circuit of the shared pixel and the sub-pixel of the shared pixel, and to turn off a path between the driving sub-circuit of the shared pixel and the sub-pixel of the sharing pixel; and controlling the sub-pixel of the sharing pixel to display using the driving sub-circuit of the shared pixel at the second moment includes, at the second moment, controlling the control switch to turn off the path between the driving sub-circuit of the shared pixel and the sub-pixel of the shared pixel, and to turn on the path between the driving sub-circuit of the shared pixel and the sub-pixel of the sharing pixel.

10. The display method according to claim 8, wherein:

the sharing pixel and the shared pixel are two of a plurality of display pixels arranged in a matrix along a row direction and a column direction in the display output area of the display screen;

the electronic device further includes:

a plurality of data lines extending along the row direction each electrically connected to a column of driving sub-circuits; and a plurality of scan lines each electrically connected to a row of driving sub-circuits; and the plurality of scan lines are configured to control a conduction state of connections between the plurality of data lines and output terminals of the driving sub-circuits;

the display method further comprising:

supplying driving signals to the scan lines one by one along the column direction to scan the driving sub-circuits row by row to control a plurality of paths, each between one row of the driving sub-circuits and the corresponding sub-pixels, to turn on sequentially; and when the path between one row of the driving sub-circuits and the corresponding sub-pixels is turned on, providing data signals through the data lines to the corresponding sub-pixels connected to the output terminals of the one row of the driving sub-circuits.

* * * * *